US005839497A

United States Patent [19]

Fujino et al.

[11] Patent Number: 5,839,497

[45] Date of Patent: Nov. 24, 1998

[54] VERTICAL DIE-CASTING METHOD AND APPARATUS

[75] Inventors: Kiyoshi Fujino; Minoru Okamura, both of Yamaguchi, Japan

[73] Assignee: U-Mold Co., Ltd., Japan

[21] Appl. No.: 952,790

[22] PCT Filed: Mar. 19, 1997

[86] PCT No.: PCT/JP97/00888

§ 371 Date: Nov. 13, 1997

§ 102(e) Date: Nov. 13, 1997

[87] PCT Pub. No.: WO97/34719

PCT Pub. Date: Sep. 25, 1997

[30] Foreign Application Priority Data

Mar. 19, 1996 [JP] Japan ..... 8-062606
Apr. 18, 1996 [JP] Japan ..... 8-096771

[51] Int. Cl.[6] ..... B22D 17/12; B22D 17/22

[52] U.S. Cl. ..... 164/113; 164/120; 164/312; 164/319

[58] Field of Search ..... 164/113, 120, 164/312, 314, 319, 321

[56] References Cited

U.S. PATENT DOCUMENTS 4,337,817 7/1982 Komatsu et al. ..... 164/113 X
4,840,557 6/1989 Ishimoto et al. ..... 425/555

FOREIGN PATENT DOCUMENTS 1-138051 5/1989 Japan .
1-321062 12/1989 Japan .
2-42292 9/1990 Japan .
5-285628 11/1993 Japan ..... 164/319
8-4198 2/1996 Japan .

*Primary Examiner*—J. Reed Batten, Jr.
*Attorney, Agent, or Firm*—Blakely Sokoloff Taylor & Zafman

[57] ABSTRACT

An interior cooling inner plunger is caused to project from an outer plunger after casting. Alternatively, during casting, while it projects from the outer plunger, the inner plunger is inserted into a frustoconical gate. Subsequently, a pressure pin is moved downward from a movable mold side to a portion near a gate portion. When a melt solidifies, a casting sleeve and a casting plunger are moved downward, and a pressure pin is further moved downward to cut apart a biscuit from a mold product. An excellent product is produced and the cycle time is shortened by a good melt pushing operation.

13 Claims, 8 Drawing Sheets

CHARGING

END OF CHARGING AND PRESSURIZATION OF PLUNGER

PRESSURIZATION OF ACURAD

PRESSURIZATION OF UPPER MOLD PRESSURE PIN

CUTTING OF BISCUIT

VERTICAL DIE-CASTING METHOD AND APPARATUS

TECHNICAL FIELD

The present invention relates to a vertical die casting method and apparatus for casting and charging a melt into a mold cavity from below the mold in order to obtain a cast product, e.g., an aluminum wheel.

BACKGROUND ART

To obtain a cast product, e.g., aluminum wheel, which requires a high strength by die casting, a vertical die casting machine is often used in order to prevent inclusion of air in the melt when the melt is to be cast.

In a method of casting an automobile aluminum wheel by using a vertical die casting machine, it is already known that casting is performed by using a gate having a diameter smaller than the inner diameter of the casting sleeve, and a unit in which a pressure pin having a diameter slightly smaller than the inner diameter of the gate can be projected into and retracted from an upper movable mold toward the lower gate, as shown in, e.g., Japanese Patent Publication No. 3-4297 (Japanese Patent Laid-Open No. 63-140747) and U.S. Pat. No. 4,840,557.

The major part of the apparatus described in Japanese Patent Publication No. 3-4297 or U.S. Pat. No. 4,840,557 is shown in FIG. 8.

Referring to FIG. 8, reference numeral 5 denotes a stationary mold serving as a lower mold; 6, a movable mold serving as an upper mold; 7, a casting sleeve joined to a casting port 25 of the stationary mold 5 from below; 12, a casting plunger; and 11, a plunger tip attached to the distal end portion of the plunger 12 and slidably arranged in the casting sleeve 7.

The upper surface of the plunger tip 11 is flat. A cooling water passage 61 is formed inside the plunger tip 11 between the outer circumferential surface and upper surface of a plunger insert block 60. A guide pipe 62 and passages 63 are formed in the axial portions of the plunger insert block 60 and plunger 12. The plunger tip 11 can be cooled by flowing cooling water to the guide pipe 62 and passages 63.

In the vertical die casting method, a stationary mold 5 having a gate 27 with a diameter smaller than that of the casting port 25 is often used in order to prevent an oxide from mixing in the melt and a chill layer formed in the melt on the inner surface portion of the casting sleeve 7 from mixing in a cavity 26, or because of the shape of the cast product, e.g., an aluminum wheel. Reference numeral 28 denotes a pressure pin arranged on the movable mold 6 side. After the melt is cast into the mold cavity 26, the pressure pin 28 is advanced downward to push the melt, and is moved downward to the gate 27 portion to cut apart solidified product portion and biscuit portion.

As shown in, e.g., Utility Model Publication No. 8-4198, it is also known that die casting is performed by using a center gate having a diameter smaller than the inner diameter of the casting sleeve, and a unit in which a center plunger that can enter the center gate can project into and retract from an outer plunger.

As shown in Japanese Patent Laid-Open No. 1-138051, it is known that, in a melt forging method of forging a melt by pushing a melt in a casting sleeve into an upper mold cavity through a gate with a plunger that can vertically move with respect to the casting sleeve, an apparatus is used in which the mold includes upper and lower molds vertically movable independently of each other, the plunger is formed as a double acting plunger consisting of an outer plunger and an inner plunger, and the gate has a diameter smaller than the diameter of the casting sleeve and larger than that of the inner plunger. First, the outer plunger and inner plunger are moved upward simultaneously to inject the melt in the casting sleeve into the cavity. Subsequently, the inner plunger is actuated to project into the gate, thus pressurizing the melt in the cavity. After the melt is solidified appropriately, the mold and the plunger are moved upward simultaneously toward the casting sleeve. When the mold and the plunger are moved upward to a predetermined height, upward movement of the lower mold and outer plunger is stopped and the upper mold and the inner plunger are moved upward, so that the product portion and the biscuit portion are cut apart. Then, the product portion and the biscuit portion are extracted.

DISCLOSURE OF INVENTION

[Problem to be Solved by the Invention]

In the apparatuses shown in Japanese Patent Publication No. 3-4297 and U.S. Pat. No. 4,840,557, the diameter of the gate and the height of the melt reservoir above the gate are determined by the shaft hole of the wheel and the design of the wheel and are not always sufficient for melt replenishment necessary for solidification and contraction of the melt.

The pressurizing direction of the pressure pin is opposite to the pressurizing direction of the plunger tip. The plunger tip moves backward due to the operation of the pressure pin. As a result, the pressure applied to the interior of the mold cavity decreases, thus decreasing the pressurizing effect.

Since the gate inlet port portion of the biscuit is thick-walled, cooling and solidification of the melt require time, prolonging the casting time.

When casting is performed by using an apparatus as shown in FIG. 8, since the interior of the center of the gate 27 through which the melt is charged into the cavity 26, i.e., a biscuit portion indicated by 64 in FIG. 8, is thick-walled, the quantity of heat dissipated from the melt during casting is large. Also, since the surface area through which the melt contacts the plunger tip 11 having a flat upper surface is small, the time required for cooling and solidification of the biscuit is prolonged. Then, the cycle time of casting is prolonged and the productivity is poor.

When the melt is cast and charged into the cavity 26, the melt solidifies and contracts quickly from its outer side because it is cooled by the mold. Then, cracks are formed on the surface of the cast product in the cavity 26, and the melt in the cast product flows to the outside through the crack portions. For example, in the case of an aluminum alloy, since Si has a low melting point, it can flow to the outside easily to cause segregation, thus degrading the strength. From these reasons, when casting is ended, it is desirable that the pressure pin 28 be actuated immediately to initiate the melt pushing operation. In fact, however, when the pressure pin 28 is advanced as soon as casting is ended, the casting-side melt is still in a liquid state, so that the plunger tip 11 is pushed back by the operation of the pressure pin 28, and a sufficient melt pushing operation cannot be obtained. Therefore, conventionally, the pressure pin 28 is actuated after a lapse of 3 to 5 seconds since casting is ended.

In the case of an automobile wheel, conventionally, although depending more or less on the size and shape of the wheel, the biscuit requires 22 to 25 seconds to cool and, e.g., 52 to 55 seconds are required for the entire cycle time.

In order to shorten the melt cooling time, thus improving the productivity, the volume of the biscuit must be reduced as much as possible to reduce its heat dissipation, and the cooling ability or heat absorbing ability of the plunger tip must be increased. In order to prolong the service life of the plunger tip, a thermal stress generated in the plunger tip must be reduced as much as possible.

In the apparatus indicated in Japanese Utility Model Publication No. 8-4198, the center plunger that should be called an inner plunger is incorporated in the casting plunger, and squeezing is performed by the operation of the center plunger. However, a good squeezing effect cannot be achieved unless the center plunger has a comparatively long advance stroke.

In this apparatus, no consideration is taken at all for cooling of the biscuit.

Although the biscuit can be cut apart at the center gate by the center plunger, in this case, it becomes difficult to extract the biscuit, and another operation is required for this purpose.

More specifically, when extracting the biscuit, while the melt is cast into the cavity and a cast product is present in the cavity, the upper and lower movable molds must be lifted simultaneously to separate them from the stationary die under them, and thereafter the casting plunger must be moved upward to project the biscuit upward from the casting sleeve. It is a matter of course that, in order to extract the cast product from the cavity, while the lower movable mold is stopped on the way, only the upper movable mold must be further moved upward. This leads to a complicated operation and a prolonged cycle time.

In Japanese Utility Model Publication No. 8-4198, the diameters of the center plunger and center gate must be almost equal.

The center plunger is arranged in the die casting machine, and the center gate is determined by the design of the mold. Therefore, the center plunger must be exchanged every time the gate diameter of the mold is changed, which is very inconvenient.

In order to produce a high-quality, high-strength aluminum-alloy cast product, a sufficiently large volume of melt must be replenished effectively at a high pressure so that a sink mark, which occurs due to solidification and contraction of the melt after the melt is charged into the mold cavity, is prevented. An oxide film which is present on the surface of the melt injected into the casting sleeve and which can cause a defect in the product, and a chill layer which occurs when the melt is cooled by the inner surface of the casting sleeve must be prevented from mixing into the product. Also, the product and the biscuit must be easily extracted.

Also, the apparatus described in Japanese Patent Laid-Open No. 1-138051 has the structure, the product, and the biscuit extracting operation that are substantially the same as those described in Japanese Utility Model Publication No. 8-4198 except that it has a pressure pin called a squeeze plunger on the stationary mold side. Hence, this apparatus has substantially the same problem as that described in Japanese Utility Model Publication No. 8-4198.

In the apparatus shown in Japanese Patent Laid-Open No. 1-138051, the pressure pin is auxiliarily provided to be moved downward slightly when the melt pushing operation of the inner plunger is insufficient. With this apparatus, a cored hole cannot be formed at the central portion of the product.

When casting an aluminum wheel, if a cored hole can be formed at the central portion of the product by the operation of the pressure pin, various effects can be obtained in the later process. More specifically, the cooling speed is increased during heating done by water cooling. Then, the cooling effect is improved, the strength of the material is increased, and the machining time is shortened.

[Means of Solution to the Problem]

The present invention has been made to solve these problems. According to the first method invention, a vertical die casting apparatus is used which has a lower stationary mold, an upper movable mold, a casting unit in which a vertical casting sleeve having a casting plunger therein is detachably mounted on a casting port under the stationary mold, a frustoconical vertical gate arranged above the casting port in the stationary mold to be coaxial with the casting port and having a diameter smaller than that of the casting port, the gate having a maximum-diameter portion on its lower side and a minimum-diameter portion on its upper side, and an interior cooling pressure pin having a diameter slightly smaller than a minimum diameter of the gate and capable of moving downward from a lower surface of the movable mold into at least the minimum-diameter portion of the gate, the casting plunger being constituted by an outer plunger and an interior cooling inner plunger arranged in an axial portion of the outer plunger to be inserted into the gate, the casting plunger is advanced to cast and charge a melt from the casting port into a mold cavity through the gate, thereafter the inner plunger is caused to project from the outer plunger and is inserted to a portion under the minimum-diameter portion in the gate to push the melt, and subsequently, the pressure pin is moved downward to a portion near the minimum-diameter portion in the gate to push the melt again, the casting sleeve and the casting plunger are moved downward when a mold product in the cavity and a biscuit are solidified, and the pressure pin is further moved downward to cut apart the biscuit from the mold product between an inner surface of the gate and an outer circumferential surface of the pressure pin, thereby letting the biscuit to fall.

When casting and charging of the melt into the cavity are ended, an advance movement of the inner plunger is started immediately, and when the advance movement of the inner plunger is ended, the pressure pin is started to move downward quickly.

According to the second method invention, a vertical die casting apparatus in which a casting plunger is constituted by an outer plunger and an interior cooling inner plunger arranged in an axial portion of the outer plunger to be inserted into the gate and constantly projecting from the outer plunger is used, and the casting plunger is advanced to cast and charge a melt from the casting port into a mold cavity through the gate, and at the same time the inner plunger projecting from the outer plunger is inserted to a portion under the minimum-diameter portion in the gate.

In the present invention, a coolant is flowed to a coolant passage in each of the pressure pin and the inner plunger to cool the melt forming a hub portion and a biscuit portion of the mold product, thereby shortening a cooling time.

According to the first apparatus invention, in a vertical die casting apparatus having a lower stationary mold, an upper movable mold, a casting unit in which a vertical casting sleeve having a casting plunger therein is detachably mounted on a casting port under the stationary mold, a frustoconical vertical gate arranged above the casting port in the stationary mold to be coaxial with the casting port and having a diameter smaller than that of the casting port, the gate having a maximum-diameter portion on its lower side and a minimum-diameter portion on its upper side, and a pressure pin having a diameter slightly smaller than a minimum diameter of the gate and capable of moving downward from a lower surface of the movable mold into at least the minimum-diameter portion of the gate, the casting plunger is constituted by an outer plunger and an inner plunger slidably arranged in an axial portion of the outer plunger, the inner plunger has a diameter smaller than a maximum diameter of the gate and is caused to project from an upper surface of the outer plunger, after casting, to be inserted into the gate, and a coolant passage is formed in each of the inner plunger, the outer plunger, and the pressure pin.

In the second apparatus invention, a casting plunger is constituted by an outer plunger and an inner plunger fixed to an axial portion of the outer plunger, and the inner plunger has a projecting portion having a diameter larger than a minimum diameter of a gate and smaller than a maximum diameter of the gate and projecting from an upper surface of the outer plunger to be able to be inserted in the gate during casting.

According to the present invention, the diameter of a portion of the inner plunger which is inserted in the gate is set smaller than a maximum diameter of an inlet port of the gate by 10 mm to 30 mm.

Also, an operation instruction unit is provided for moving the pressure pin downward to a portion near the minimum-diameter portion in the gate immediately after a lapse of several seconds since the inner plunger is inserted in the gate, moving the casting sleeve and the casting plunger downward when a time required for solidification of a mold product in the cavity or a biscuit has elapsed, and moving the pressure pin further downward.

[Effect]

The present invention is made as described in the scope of claims and accordingly has effects as follows.

(1) Since the gate having a smaller diameter than that of the casting sleeve is formed, the flow of the oxide on the surface of the melt into the cavity is decreased during melt charging, and the flow of the solidified chill layer formed on the inner wall of the casting sleeve into the cavity is prevented to decrease foreign matters in the product, thereby decreasing defective cast products.

(2) Since the inner plunger also called an Acurad pin is arranged in the casting plunger in addition to the pressure pin on the side of the movable mold serving as the upper mold, a sufficient volume of melt is replenished during solidification and contraction. Since the pin pressure is caused to act effectively, a high-strength cast product having a dense texture can be obtained.

(3) The cycle time of casting can be shortened because of the cooling effect of the inner plunger and pressure pin, thus improving the productivity.

(4) The biscuit is cut apart by the pressure pin on the movable mold side to facilitate the post-processing process for the cast product.

When casting an aluminum wheel, since a cored hole can be formed at the central portion of the cast product with the operation of the pressure pin, the cooling speed is increased during heating done by water cooling. The cooling effect is improved, the strength of the material is increased, and the machining time is shortened.

(5) The weight of the melt can be decreased, and accordingly the melt supply amount can be decreased.

Particularly, in the present invention, when casting an aluminum wheel, (6) the inner plunger having a comparatively large diameter is inserted down to a portion under the minimum-diameter portion in the frustoconical gate to push the melt, and the inner plunger is cooled. Therefore, the thick-walled portion of the biscuit is eliminated, and the cooling effect is increased, so that the biscuit cooling time can be shortened to 15 to 18 seconds. This corresponds to a decrease in cooling time by about 5 to 8 seconds when compared to a conventional case, leading to a high productivity.

If the inner plunger is caused to project from the outer plunger after casting, both the melt pushing effect and the cooling effect from the casting side are enhanced. If a structure obtained by integrating an inner plunger in a projecting state and an outer plunger is employed, improvement in the cooling effect becomes the major purpose.

Even when a structure obtained by integrating an inner plunger in a projecting state and an outer plunger is employed, if the diameter of the inner plunger is set smaller than the diameter of the inlet port of the circular gate by 10 to 30 mm, cooling and solidification of the melt achieved by the cooling operation of the projecting portion can be done quickly while ensuring a passage area necessary for charging the melt in the cavity.

(7) If the present invention is employed, the cooling effect is increased because of a decrease in thickness of the biscuit portion and of the cooling operation done by the inner plunger, thus shortening the solidification time of the biscuit portion. After casting is ended, a certain time has elapsed until the pressure pin is actuated, because the inner plunger is actuated. Since the pressure of the pressure pin is not transmitted to the plunger tip side, when projection of the inner plunger is ended after casting, the pressure pin can be immediately caused to project, so that the cycle time can be shortened considerably.

Even when a structure obtained by integrating an inner plunger in a projecting state and an outer plunger is employed, the cooling effect is enhanced because of a decrease in thickness of the biscuit portion and of the cooling operation done by the inner plunger, thus shortening the solidification time of the biscuit portion. Since the pressure of the pressure pin is not easily transmitted to the plunger tip side, after casting, the pressure pin can be caused to project comparatively quickly, e.g., within one second, so that the cycle time can be shortened.

(8) In the present invention, it suffices if the diameter of the inner plunger is decreased to be smaller than the diameter of the inlet port of the circular gate by 10 to 30 mm, leading to an extra margin in size. Even if the size of the circular gate of the mold changes due to the specific design of the aluminum wheel to be cast, the inner plunger need not be exchanged in practice. One inner plunger can be used in common, which is very convenient.

(9) Furthermore, in the present invention, since the inner plunger is pushed into the biscuit, the weight of the biscuit is decreased. When casting an aluminum wheel, the use amount of the melt during casting is decreased by about 0.4 kg, leading to a decrease in cost. Since the heat dissipation amount is decreased accordingly, an increase in temperature of the mold is suppressed, the service life of the mold is prolonged, and the amount of mold release agent is decreased.

(10) According to the present invention, a radial gap is formed between the gate and the inner plunger. Even when the inner plunger is moved backward, the biscuit remains in the mold. Thereafter, the biscuit is cut apart and pushed off by the operation of the pressure pin. Accordingly, the biscuit can be extracted easily.

Since the inner surface of the gate forms a tapered surface the diameter of which decreases upward from the inlet port of the gate, the melt flow during casting and transmission of the casting pressure are improved, and downward extraction of the biscuit is facilitated.

(11) When a structure obtained by integrating an inner plunger in a projecting state and an outer plunger is employed, if the outer plunger and the inner plunger are fabricated separately from each other and are assembled together integrally, occurrence of a thermal stress is comparatively decreased, and the service life of the plunger is comparatively prolonged.

(12) An apparatus having a structure that can be operated easily in practice can be provided.

BEST MODE OF CARRYING OUT THE INVENTION

[First Embodiment]

FIG. 1, FIG. 2, FIGS. 3A to 3C, and FIGS. 4A and 4B show the first embodiment of the present invention.

Figure 1:
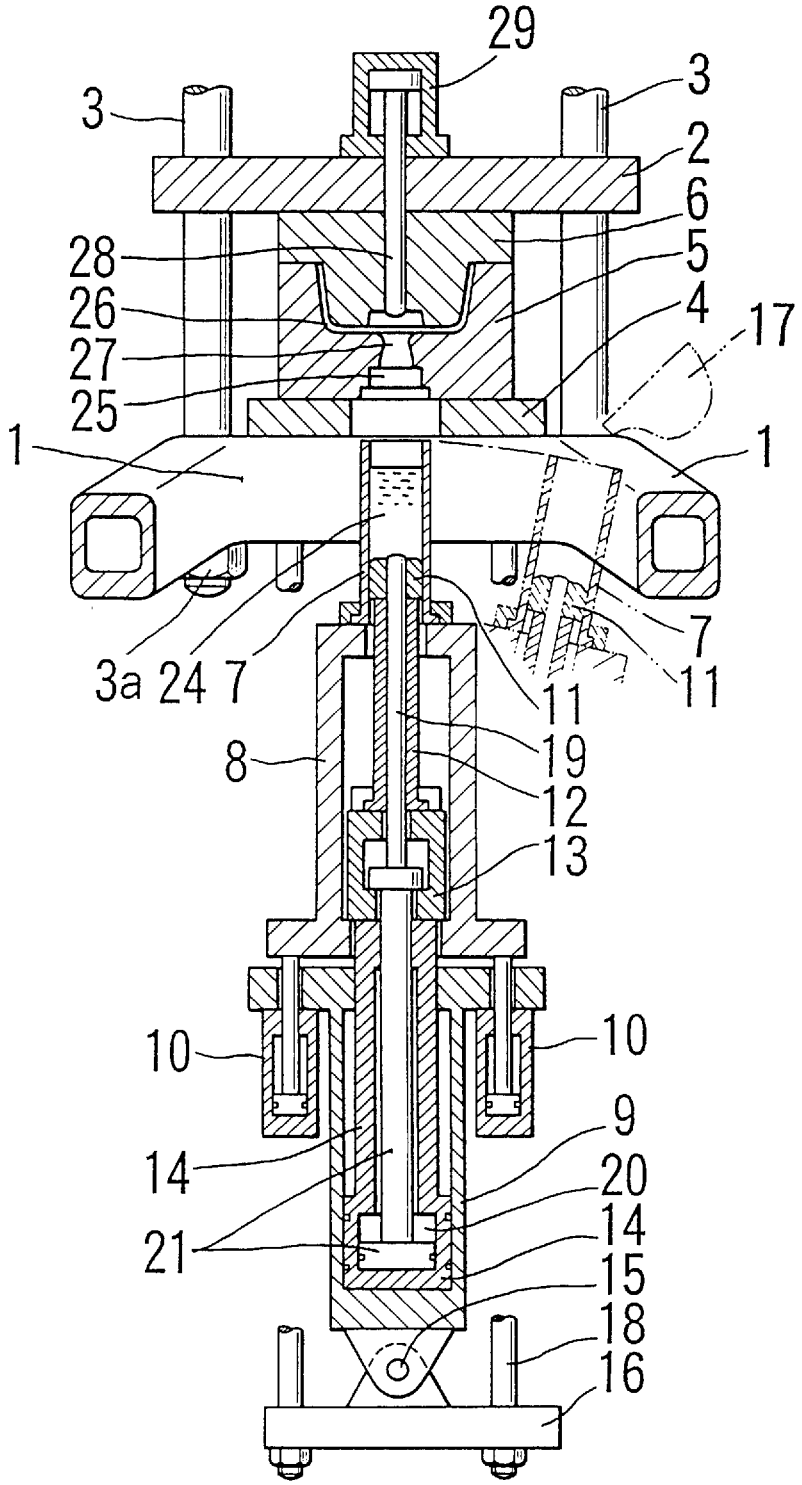
FIG. 1 shows the first embodiment of an apparatus for practicing the method of the present invention, and is a longitudinal sectional view of a casting machine in a state immediately before its casting unit is joined to a stationary mold.

FIG. 1 is a longitudinal sectional view of a casting machine in a state wherein the melt is charged into the casting sleeve at the position indicated by an alternate long and two short dashed line and immediately before its casting unit which is set vertical by a tilted rotation cylinder (not shown) is joined to the stationary mold. A known mold closing unit is used and is not shown accordingly.

Figure 2:
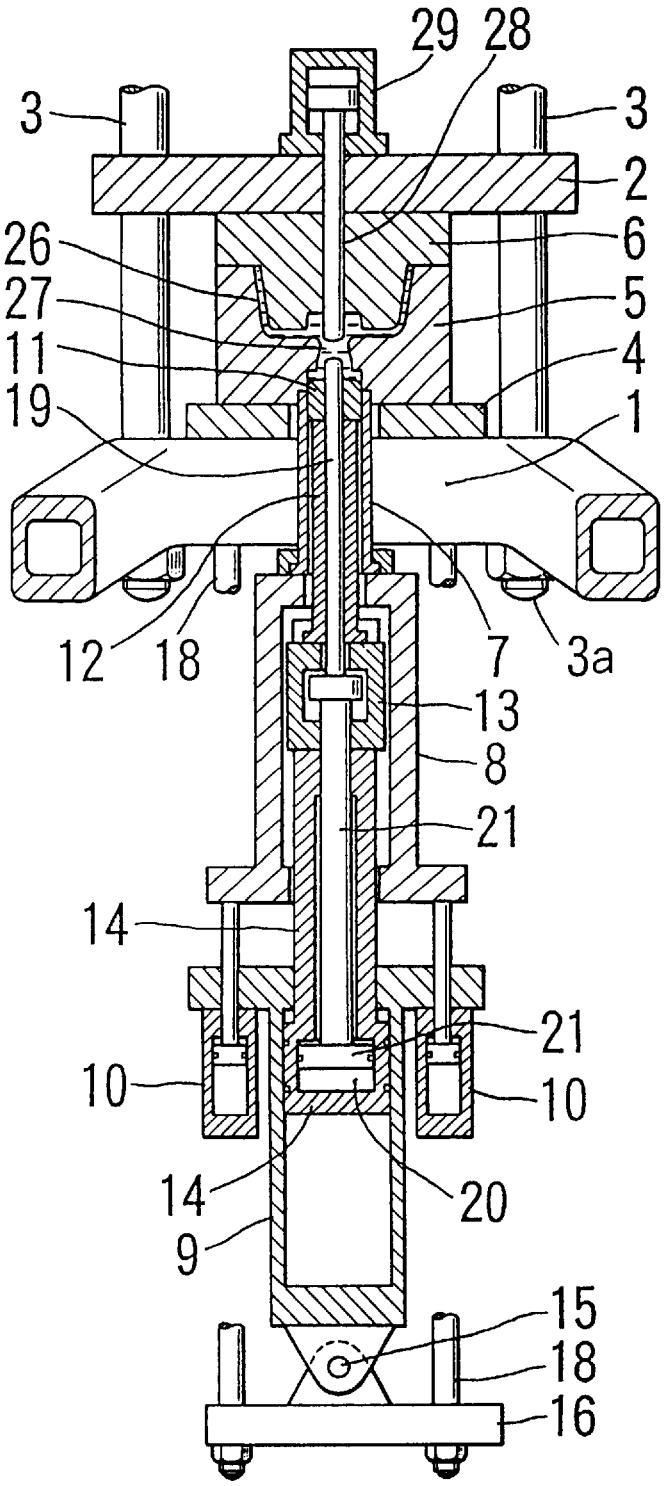
FIG. 2 is a longitudinal sectional view showing a state in the first embodiment wherein the inner plunger and the pressure pin actuate.

FIG. 2 is a longitudinal sectional view of the casting machine showing joining, casting, pressurization of the inner plunger, and pressurization states of the pressure pin. FIGS. 3A to 3C, and FIGS. 4A and 4B are views showing the operation sequences from melt charging into the cavity till pushing off of the biscuit.

Referring to FIGS. 1 and 2, reference numeral 1 denotes the horizontal stationary disk of a vertical die casting machine or vertical squeeze casting machine; 2, a movable disk which vertically moves in a horizontal state; 3, columns; 3*a,* column nuts; 4, a stationary mold back-up plate fixed to the stationary disk 1; 5, a stationary mold serving as a lower mold; and 6, a movable mold serving as an upper mold.

Reference numeral 7 denotes a casting sleeve detachably mounted on the stationary mold 5 to be mountable/detachable under the central portion of the stationary mold 5; 8, a joining frame formed integrally with the casting sleeve 7; 9, a casting cylinder; 10, joining cylinders arranged at the upper portion of the casting cylinder 9 to vertically move the casting sleeve 7 and joining frame 8; 11, a plunger tip slidably arranged in the casting sleeve 7 and called an outer plunger as well; 12, a casting plunger; 13, a plunger joint; and 14, a piston and a piston rod of the casting cylinder 9. Vertical movement of the piston and piston rod 14 can vertically move the plunger 12 and plunger tip 11.

The bottom portion of the casting cylinder 9 is pivotally attached to a casting cylinder attaching plate 16 through a tilting shaft 15. The casting cylinder 9 as well as the casting sleeve 7, the plunger tip 11, and the like can be tilted by the operation of a tilting unit (not shown) to such positions that a ladle 17 can supply the melt to them, as indicated by an alternate long and two short dashed line in FIG. 1. Reference numeral 18 denotes casting cylinder mounting tie bars 18.

An inner plunger 19 is arranged to extend through the axial portions of the plunger tip 11 and plunger 12. The inner plunger 19 is slidable in the axial direction, and its distal end can project from and retract into the plunger tip 11. The inner plunger 19 is conventionally called an Acurad pin or a center plunger.

In the first embodiment, the plunger tip 11 is located on the outer side. Hence, reference numeral 11 will denote an outer plunger; and 19, an inner plunger hereinafter. Accordingly, the outer plunger 11 and the inner plunger 19 constitute a casting plunger.

An inner cylinder 20 is arranged in the axial portions of the piston and piston rod 14 of the casting cylinder 9. A piston and a piston rod 21 of the inner cylinder 20 are arranged in the inner cylinder 20.

A cooling water passage 22 and a pipe 23 are formed in the inner plunger 19, as shown in FIGS. 3A to 3C, and FIGS. 4A and 4B, to internally cool the inner plunger 19. Reference numeral 24 denotes a melt.

For example, an annular recessed portion having a draft with a width of about 0.05 mm to 1 mm and a depth of about 10 mm can be formed at a portion in the distal end portion of the outer plunger 11 where the inner plunger 19 extends.

If this recessed portion is formed, when the melt 24 is supplied into the casting sleeve 7, the melt 24 enters this recessed portion and is solidified quickly. Then, the melt 24 can be prevented from flowing into the gap between the inner plunger 19 and outer plunger 11. The recessed portion thus serves as a piston ring and can prevent seizing of the inner plunger 19.

Reference numeral 25 denotes a casting port formed at the central portion in the lower side of the stationary mold 5. The upper end portion of the casting sleeve 7 is joined to this casting port 25 portion, as described above. The inner diameter of the casting port 25 is equal to the inner diameter of the casting sleeve 7. The outer plunger 11 moves upward till partly reaching the inner surface of the casting port 25.

A circular gate 27 having a diameter smaller than the inner diameter of the casting sleeve 7 and communicating with a cavity 26 in the molds 5 and 6 is formed above the axial portion of the casting port 25.

The upper end portion of the gate 27 has a comparatively small diameter, and its lower side spreads like a trumpet. More specifically, the gate 27 has a frustoconical shape having the maximum-diameter portion on its lower side and the minimum-diameter portion on its upper side. The diameter of the inner plunger 19 can be comparatively increased, e.g., to be larger than the minimum diameter of the gate 27. Therefore, the diameter of the inlet port portion of the gate 27 is set slightly larger than the diameter of the inner plunger 19 by, e.g., 10 mm to 30 mm, so that the inner plunger 19 can be inserted till the interior of the gate 27. A gap is formed between the gate 27 and inner plunger 19 so that, even if the design of the design surface of the aluminum wheel to be cast may be changed more or less, the diameter of the inner plunger 19 need not be changed accordingly.

Reference numeral 28 denotes a pressure pin arranged at the central portion of the movable mold 6 to be retractably movable downward; and 29, a pressure pin cylinder. A cooling water passage 30 and a pipe 31 are formed in the pressure pin 28, as shown in FIGS. 3A to 3C and FIGS. 4A and 4B to internally cool the pressure pin 28.

The diameter of the pressure pin 28 is set slightly smaller than the inner diameter of the minimum-diameter portion of the circular gate 27 by, e.g., 0.2 mm to 0.5 mm. When the pressure pin 28 is advanced downward, its distal end portion can enter the gate 27.

The operation of the above arrangement will be described with reference to FIGS. 1 and 2, FIGS. 3A and 3B, and FIG. 4A.

Figure 3A:
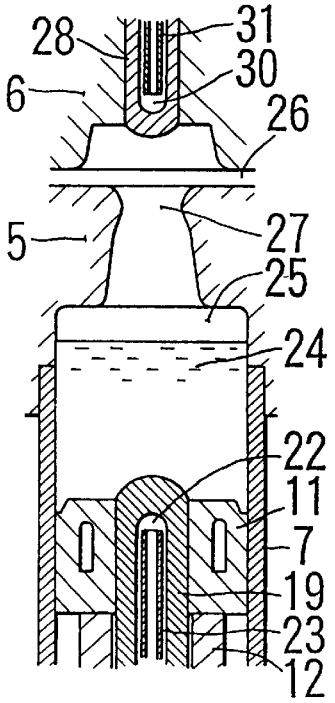
FIGS. 3A to 3C are longitudinal sectional views showing the operation sequence of the first embodiment of a state before charging the melt into the cavity, melt charging, and actuation of the inner plunger.

After the molds are closed, when the casting unit is in the tilted state indicated by an alternate long and two short dashed line in FIG. 1, the melt 24 is injected into the casting sleeve 7. When the tilt state is canceled, the casting sleeve 7 is set vertical, as shown in FIG. 1, and is pushed upward by the joining cylinders 10 through the joining frame 8 to be joined to the casting port 25 of the stationary mold 5. FIG. 3A shows a state wherein casting is started after joining.

Figure 3B:
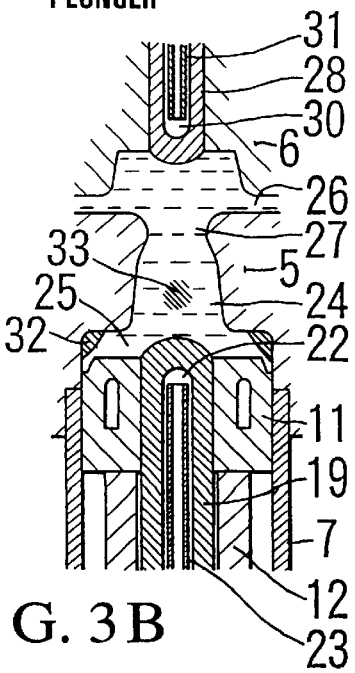

Subsequently, the outer plunger 11, the plunger 12, and the inner plunger 19 are moved upward simultaneously by the operation of the piston and piston rod 14 of the casting cylinder 9 to charge the melt 24 into the mold cavity 26 through the gate 27, and to pressurize the melt 24 with the plunger tip consisting of the outer plunger 11 and inner plunger 19. FIG. 3B shows this state.

During melt charging, the oxide layer on the outer peripheral portion of the surface of the melt in the casting sleeve 7, and the chill layer cooled and formed on the inner surface of the casting sleeve 7 remain at the corners of the ceiling portion of the outer periphery of the inlet port of the gate 27 of the casting port 25 and do not flow into the gate 27, thus eliminating the cause of defective products.

Figure 3C:
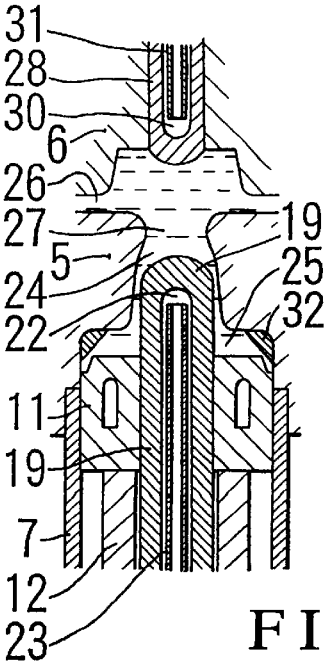

Upon detection of an increase in operating pressure of the casting cylinder 9 or the moving position of the casting cylinder 9, when completion of melt charging is detected, solidification and contraction of the melt start after melt charging are complete. The piston and piston rod 21 of the inner cylinder 20 incorporated in the piston and piston rod 14 of the casting cylinder 9 are advanced immediately to advance the inner plunger 19 immediately. The inner plunger 19 is caused to project to a portion under the minimum-diameter portion in the gate 27, thus pushing the melt. FIG. 3C shows this state.

The upper portion of the outer periphery of the casting port 25 solidifies quickly since a chill layer 32 solidified in the casting sleeve 7 is deposited on it and it is cooled by the stationary mold 5 as well. However, as shown in FIG. 3B, the melt 24 at the central portion of the circular gate 27 which will form a finally solidified portion 33 is cooled slowly and is thus still in a molten state. Therefore, the pressure caused by the inner plunger 19 that acts in the same direction as the direction of pressurization caused by the outer plunger 11 serves effectively to replenish the melt 24 into the cavity 26 and to pressurize the interior of the cavity 26 with a high pressure.

In this case, since the direction of pressurization of the inner plunger 19 is equal to that of the outer plunger 11, the pressure caused by the inner plunger 19 can advance the outer plunger 11 without reducing the pressure of the outer plunger 11. Pressurization caused by the inner plunger 19 is started well before solidification progresses. The inner plunger 19 can pressurize the interior of the cavity 26 with a further high pressure through the gate 27 by effectively utilizing its volume. As a result, a dense cast product can be obtained.

The inner plunger 19 having a comparatively large diameter, e.g., larger than the minimum diameter of the gate 27, is inserted into the frustoconical gate 27 having the maximum-diameter portion on its lower side and the minimum-diameter portion on its upper side. Accordingly, the advance stroke of the inner plunger 19 can be comparatively small.

When the advance movement of the inner plunger 19 is complete, the melt 24 at the inlet port portion of the gate 27 is cooled both by the stationary mold 5 serving as the lower mold and the inner plunger 19, so that it is cooled quickly. In this case, due to the advance movement of the inner plunger 19, the melt 24 at the inlet port portion of the gate 27 is thin with a circular section and is cooled also by the inner plunger 19 the interior of which is cooled with water. Therefore, the biscuit is cooled and solidified quickly.

Subsequently, the pressure pin 28 of the movable mold 6 serving as the upper mold is advanced to continue replenishment and pressurization of the melt to the mold cavity 26, thus performing the melt pushing operation again.

Figure 4A:
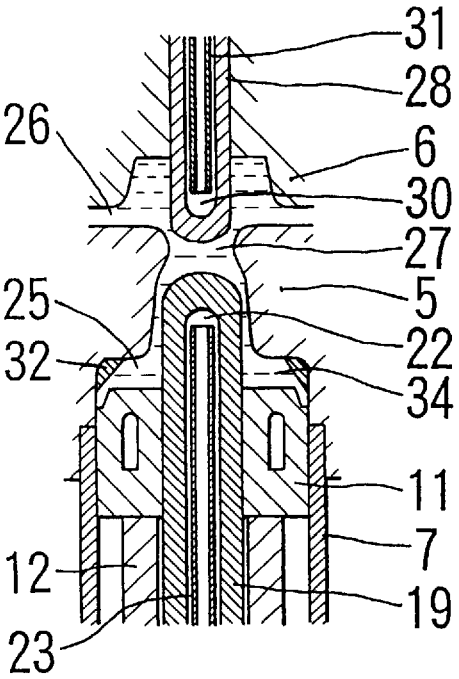
FIGS. 4A and 4B are longitudinal sectional views showing the operation sequence following the operation sequence of FIGS. 3A to 3C.

In this case, the distal end of the pressure pin 28 of the movable mold 6 is stopped immediately before or at the minimum-diameter portion at the upper portion of the gate 27. FIGS. 2 and 4A show this state.

In this case, the inlet port portion of the gate 27 is cooled. The Pascal's principle does not substantially effect on the surface of the plunger tip consisting of the outer plunger 11 and inner plunger 19 and thus does not push back the plunger tip. The pressure pin 28 can be advanced immediately to shorten the casting time.

Both the advance movement of the inner plunger 19 and the advance movement of the pressure pin 28 are performed comparatively slowly to take, e.g., 2 to 3 seconds. The advanced positions with respect to the lapse of time are preferably determined in advance in accordance with the progress of contraction of the melt in the cavity 26 so that the two advance movements are controlled along preset curves.

When solidification in the mold cavity 26 and of a biscuit 34 is complete, the outer plunger 11 and the inner plunger 19 are moved backward. At this time, since a gap is present between the gate 27 and inner plunger 19, even if the outer plunger 11 and inner plunger 19 are moved backward, the biscuit 34 remains on the stationary mold 5 side.

Figure 4B:
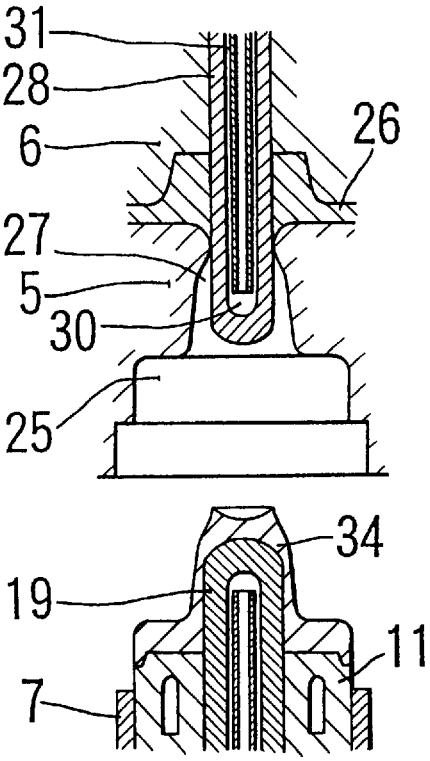

In this state, the pressure pin 28 of the movable mold 6 serving as the upper mold is advanced again to cut apart the cast product in the mold cavity 26 and the biscuit 34 with the minimum-diameter portion of the gate 27 and to push off the biscuit 34. FIG. 4B shows this state.

Thereafter, molds are opened, and the cast product is extracted.

[Second Embodiment]

Figure 5:
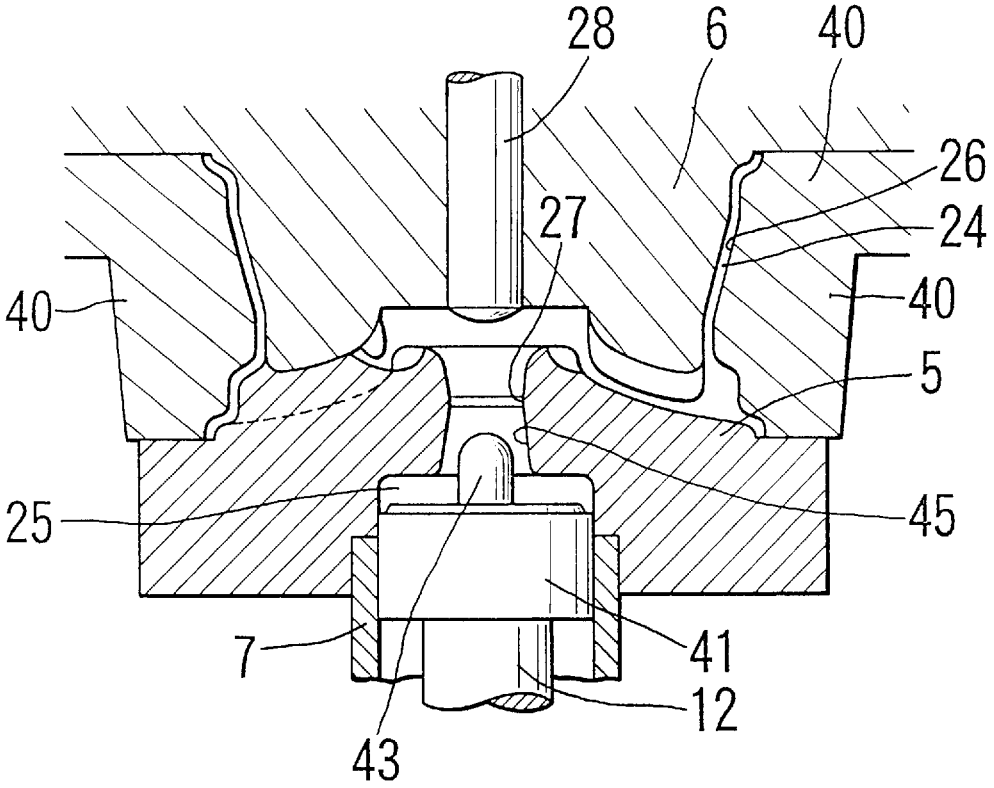
FIG. 5 is a longitudinal sectional view showing the second embodiment of an apparatus for practicing the method of the present invention by way of casting an aluminum wheel.
Figure 6:
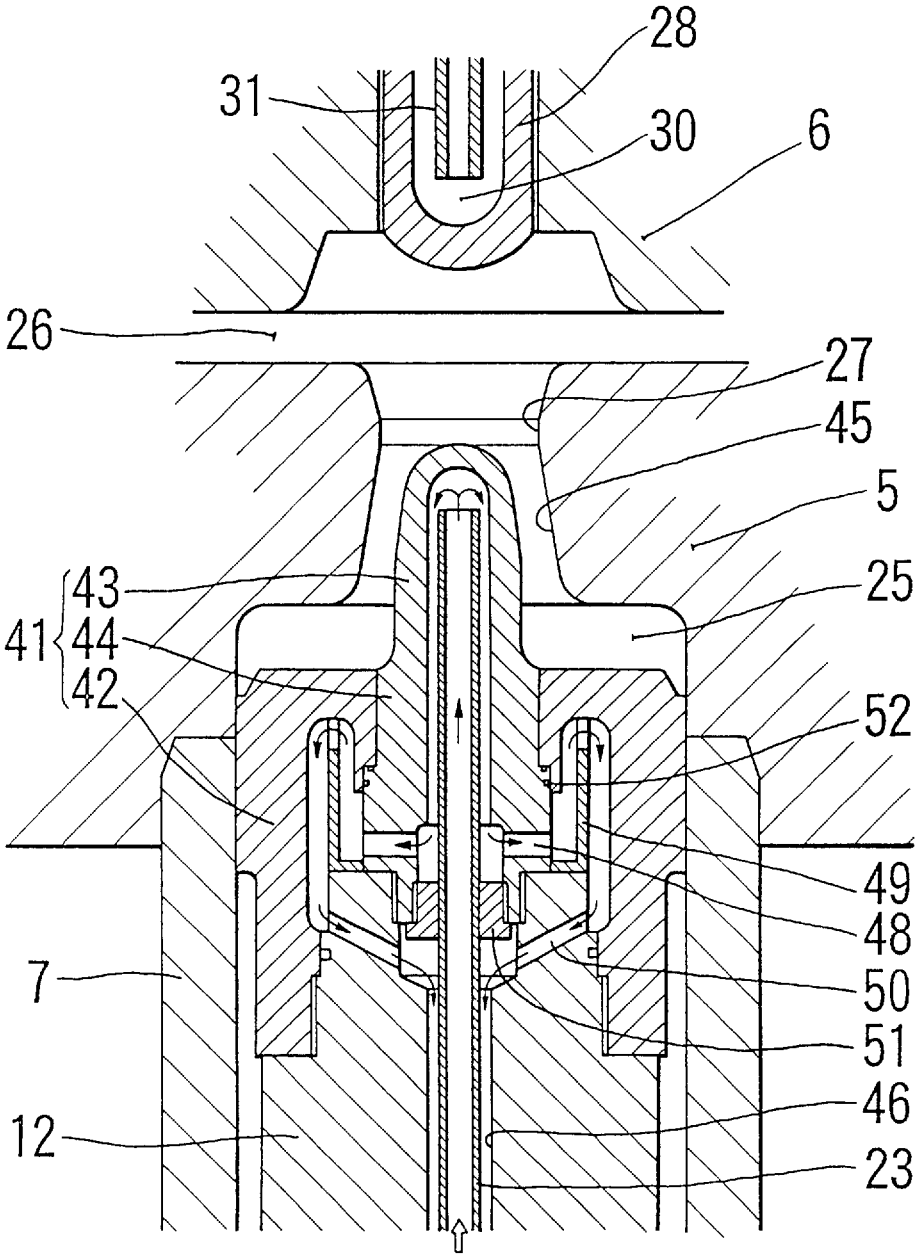
FIG. 6 is a longitudinal sectional view showing an example of a plunger tip portion of the second embodiment.

FIGS. 5 and 6 show the second embodiment of the present invention.

In FIGS. 5 and 6, components identical to those shown in FIGS. 1 and 2, FIGS. 3A to 3C, and FIGS. 4A and 4B are denoted by the same reference numerals, and a detailed description thereof will be omitted.

FIG. 5 shows a case wherein an automobile aluminum wheel is die-cast by using a stationary mold 5 serving as a lower mold, a movable mold 6 serving as an upper mold, and a slide core 40 divided into four portions in the circumferential direction.

A plunger tip 41 is constituted by an outer plunger tip portion 42 and an inner plunger tip portion 44 that are concentric. The inner plunger tip portion 44 has a projecting portion 43 constantly projecting from the upper surface of the outer plunger tip portion 42. The outer diameter of the projecting portion 43 is set smaller than the diameter of the inlet port of a circular gate 27.

The inner surface of the gate 27 forms a tapered surface 45 the diameter of which decreases upward from the inlet port of the gate 27. The outer diameter of the projecting portion 43 of the inner plunger tip portion 44 is set smaller than the diameter of the inlet port of the gate 27 by 10 mm to 30 mm for the following purposes. Namely, a passage area which is necessary for charging a melt 24 in the cavity must be ensured. A biscuit portion must be as thin as possible so that it can be cooled and solidified quickly. Then, the thickness of the biscuit portion is sufficient for transmitting a force required for pushing off the biscuit with a pressure pin 28.

FIG. 6 shows the plunger tip 41 formed by integrally assembling the inner plunger tip portion 44 and outer plunger tip portion 42 that are separate from each other.

A cooling water passage is formed between the inner surfaces of the inner plunger tip portion 44 and outer plunger tip portion 42.

When moving the plunger tip 41 upward to cast the melt 24 into the mold cavity 26, the projecting portion 43 of the inner plunger tip portion 44 deeply enters the gate 27. Hence, the melt pushing volume decreases accordingly, and the heat dissipation amount decreases.

The quantity of heat absorbed by the inner plunger tip portion 44 and outer plunger tip portion 42 is carried away by the coolant flowing through the plunger tip 41 to suppress an extreme temperature increase of the plunger tip portions 42 and 44, thereby cooling the biscuit portion.

At this time, since the projecting portion 43 is formed and its interior is cooled, the outer surface area of the inner plunger tip portion 44 and the coolant passage area in the inner plunger tip portion 44 are larger than those of the conventional case, leading to a large cooling ability. Also, the heat dissipation amount decreases, thus shortening the solidification time.

The coolant for cooling the plunger tip 41 is supplied through a pipe 23 extending through a hole 46 formed at the center of a casting plunger 12, is injected in the distal end of the inner plunger tip portion 44, moves downward while cooling the inner periphery of the inner plunger tip portion 44, enters the outer plunger tip portion 42 through a passage 48 formed in the lower portion of the inner plunger tip portion 44, and flows on the inner and outer surfaces of a partition wall 49 to cool the outer plunger tip portion 42. The coolant then flows into the hole 46 from a passage 50 formed in the plunger 12 and is discharged to the outside.

A partition plug 51 is a partition for causing the coolant to flow to the outer plunger tip portion 42. The arrows indicate the flow of the coolant.

The inner plunger tip portion 44 and the outer plunger tip portion 42 are concentric and are screwed in the plunger 12. The gap between the inner plunger tip portion 44 and outer plunger tip portion 42 is sealed with a packing 52 so that the coolant will not flow out.

In this manner, if the inner plunger tip portion 44 and the outer plunger tip portion 42 are fabricated separately and are assembled together, a thermal stress generated in each of the inner plunger tip portion 44 and the outer plunger tip portion 42 is small, and the service life till reaching fatigue fracture is prolonged.

In this second embodiment, once the melt 24 is cast and charged into the mold cavity 26, the pressure pin 28 is actuated in the same manner as in the first embodiment.

In this second embodiment, because of a decrease in thickness of a biscuit 34 and of the cooling operation of the projecting portion 43 of the inner plunger tip portion 44, the cooling effect is increased and solidification of the biscuit 34 is quickened, so that the pressure of the pressure pin 28 will not be easily transmitted to the plunger tip 41 side. After casting, the pressure pin 28 can be caused to project comparatively quickly, e.g., within one second, thus shortening the cycle time.

[Third Embodiment]

Figure 7:
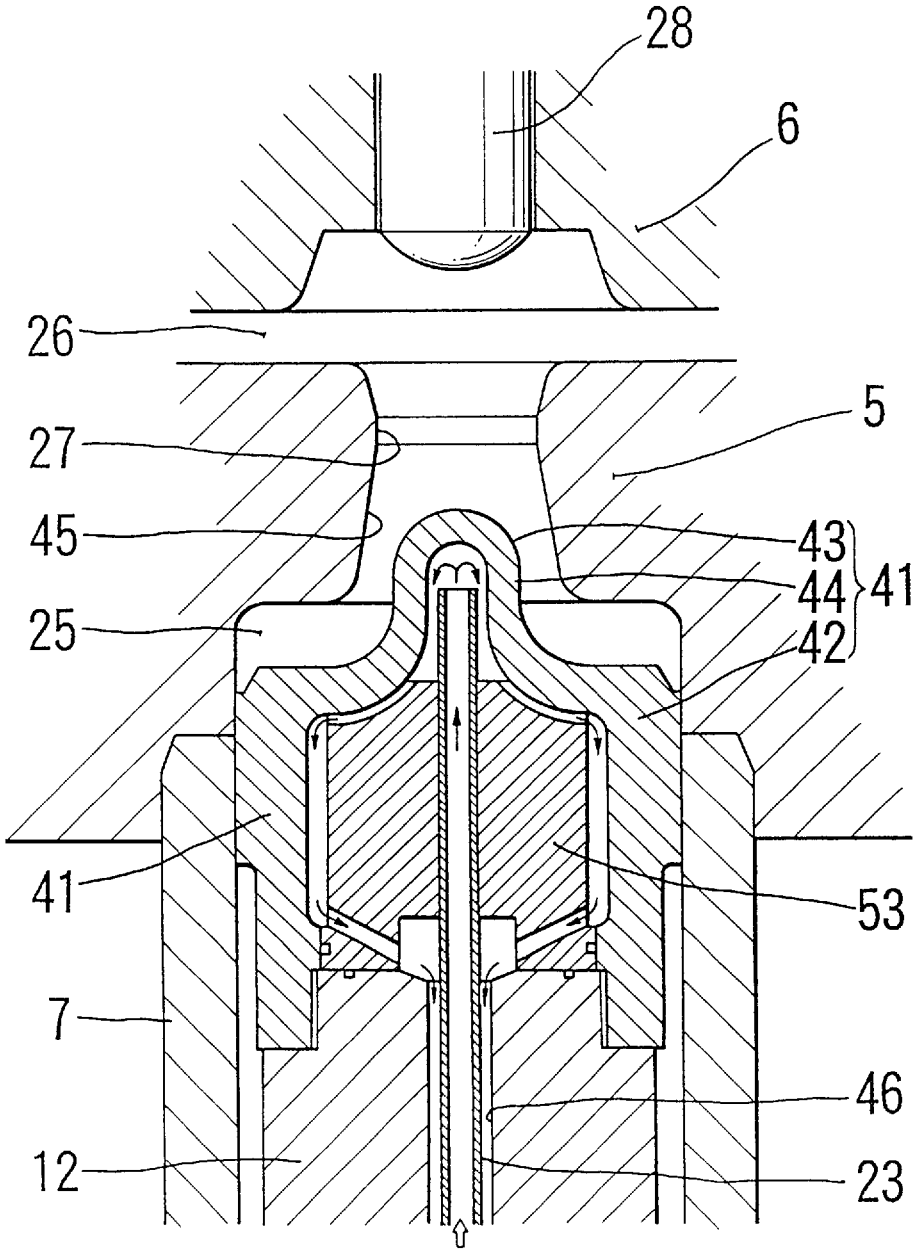
FIG. 7 is a longitudinal sectional view showing a plunger tip portion according to the third embodiment.
Figure 8:
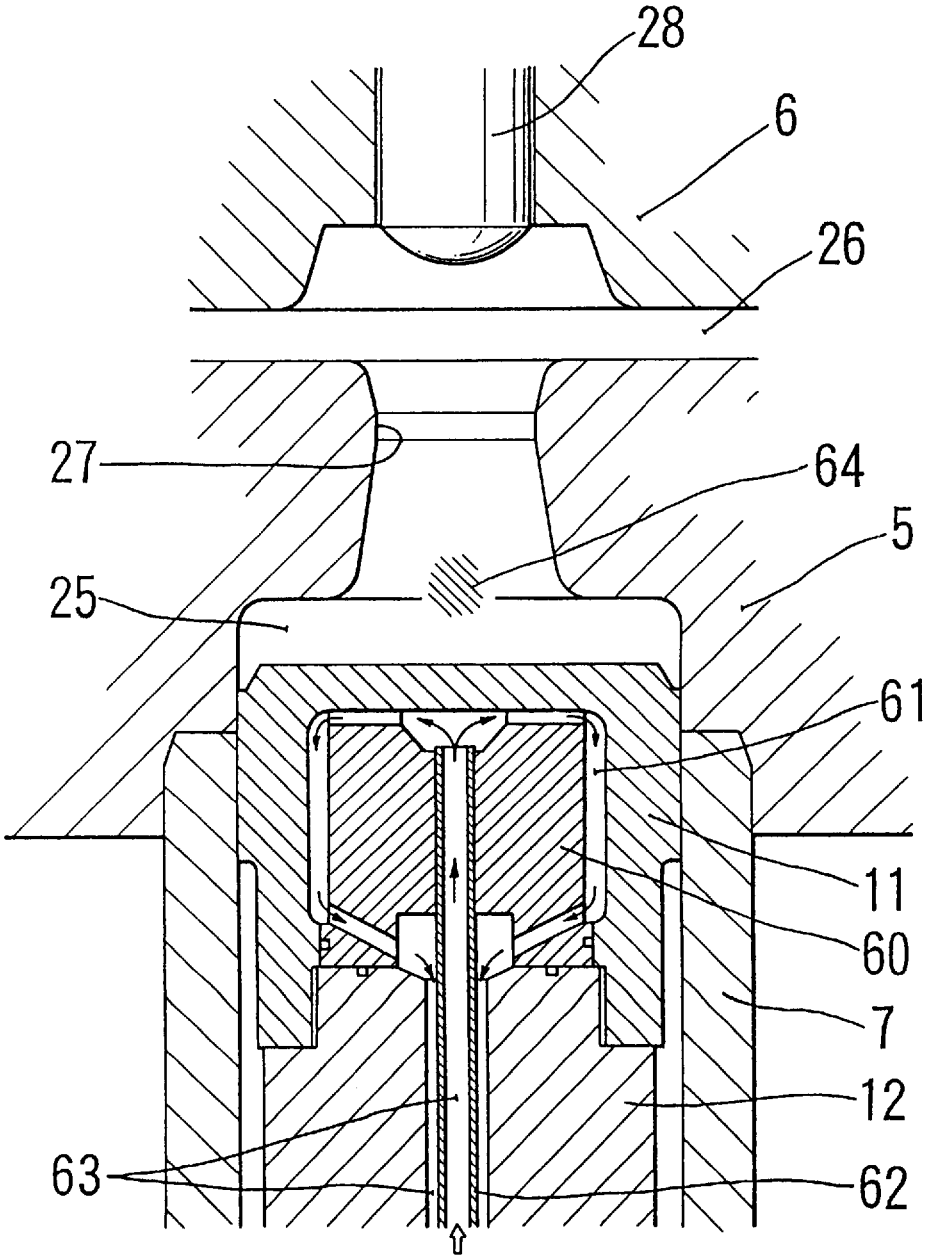
FIG. 8 PRIOR ART
FIG. 8 is a longitudinal sectional view showing an example of a conventional plunger tip portion similar to the present invention.

FIG. 7 shows still another embodiment of the present invention, in which an outer plunger tip portion 42 and an inner plunger tip portion 44 having a projecting portion 43 are integrated from the beginning to form a plunger tip 41.

A coolant passage is formed in the plunger tip 41 by using a plunger insert block 53, a pipe 23, and the like.

During charging, heat of solidification and sensible heat of a melt 24, e.g., an aluminum alloy, are dissipated within a short period of time. If the heat absorbing ability of the coolant becomes short, the temperature of the inner plunger tip portion 44 increases. When solidification is complete, heat will not be dissipated from the melt 24, cooling of the interior with the coolant progresses, and the temperature of the inner plunger tip portion 44 decreases. This temperature change is larger in the inner plunger tip portion 44 than in the outer plunger tip portion 42.

Accordingly, if the outer plunger tip portion 42 and inner plunger tip portion 44 of the plunger tip 41 are completely integral, as shown in FIG. 7, the temperature difference in the plunger tip 41 increases. A comparatively large repeated thermal stress is generated to cause fatigue fracture, leading to a short service life. In this respect, the structure in which the outer plunger tip portion 42 and the inner plunger tip portion 44 form two separate components, as shown in FIG. 6, is more excellent than that shown in FIG. 7.

It is a matter of course that, with the structure shown in fig. 7 as well, the volume of the biscuit portion decreases, and the biscuit portion is cooled quickly since it is cooled from inside the plunger tip 41.

We claim:

1. A vertical die casting method comprising using a vertical die casting apparatus having a lower stationary mold, an upper movable mold, a casting unit in which a vertical casting sleeve having a casting plunger therein is detachably mounted on a casting port under said stationary mold, a frustoconical vertical gate arranged above said casting port in said stationary mold to be coaxial with said casting port and having a diameter smaller than that of said casting port, said gate having a maximum-diameter portion on its lower side and a minimum-diameter portion on its upper side, and an interior cooling pressure pin having a diameter slightly smaller than a minimum diameter of said gate and capable of moving downward from a lower surface of said movable mold into at least said minimum-diameter portion of said gate, said casting plunger being constituted by an outer plunger and an interior cooling inner plunger arranged in an axial portion of said outer plunger to be inserted into said gate, advancing said casting plunger to cast and charge a melt from said casting port into a mold cavity through said gate, thereafter causing said inner plunger to project from said outer plunger, and inserting said casting plunger to a portion under said minimum-diameter portion in said gate to push said melt, and subsequently, moving said pressure pin downward to a portion near said minimum-diameter portion in said gate to push said melt again, moving said casting sleeve and said casting plunger downward when a mold product in said cavity and a biscuit are solidified, and further moving said pressure pin downward to cut apart said biscuit from said mold product between an inner surface of said gate and an outer circumferential surface of said pressure pin, thereby letting said biscuit to fall.

2. A vertical die casting method according to claim 1, comprising when casting and charging of said melt into said mold cavity are ended, starting an advance movement of said inner plunger immediately, and when the advance movement of said inner plunger is ended, starting said pressure pin to move downward quickly.

3. A vertical die casting method comprising using a vertical die casting apparatus having a lower stationary mold, an upper movable mold, a casting unit in which a vertical casting sleeve having a casting plunger therein is detachably mounted on a casting port under said stationary mold, a frustoconical vertical gate arranged above said casting port in said stationary mold to be coaxial with said casting port and having a diameter smaller than that of said casting port, said gate having a maximum-diameter portion on its lower side and a minimum-diameter portion on its upper side, and an interior cooling pressure pin having a diameter slightly smaller than a minimum diameter of said gate and capable of moving downward from a lower surface of said movable mold into at least said minimum-diameter portion of said gate, said casting plunger being constituted by an outer plunger and an interior cooling inner plunger arranged in an axial portion of said outer plunger to be inserted into said gate and constantly projecting from said outer plunger, advancing said casting plunger to cast and charge a melt from said casting port into a mold cavity through said gate, and at the same time inserting said inner plunger projecting from said outer plunger to a portion under said minimum-diameter portion in said gate, and subsequently, after a lapse of several seconds, moving the pressure pin downward to a portion near said minimum-diameter portion in said gate to push said melt again, moving said casting sleeve and said casting plunger downward when a mold product in said cavity and a biscuit are solidified, and further moving said pressure pin downward to cut apart said biscuit from said mold product between an inner surface of said gate and an outer circumferential surface of said pressure pin, thereby letting said biscuit to fall.

4. A vertical die casting method according to claim 3, wherein a structure formed by integrally assembling an inner plunger portion and an outer plunger portion that are separate from each other is used as said casting plunger.

5. A vertical die casting method according to any one of claims 1 to 4, wherein a coolant is flowed to a coolant passage in each of said pressure pin and said inner plunger to cool said melt forming a hub portion and a biscuit portion of said mold product, thereby shortening a cooling time.

6. A vertical die casting method according to any one of claims 1 to 4, wherein die casting is performed by using an apparatus in which a diameter of said inner plunger is set smaller than a maximum diameter of an inlet port of said gate by 10 mm to 30 mm.

7. A vertical die casting apparatus having a lower stationary mold, an upper movable mold, a casting unit in which a vertical casting sleeve having a casting plunger therein is detachably mounted on a casting port under said stationary mold, a frustoconical vertical gate arranged above said casting port in said stationary mold to be coaxial with said casting port and having a diameter smaller than that of said casting port, said gate having a maximum-diameter portion on its lower side and a minimum-diameter portion on its upper side, and a pressure pin having a diameter slightly smaller than a minimum diameter of said gate and capable of moving downward from a lower surface of said movable mold into at least said minimum-diameter portion of said gate, wherein said casting plunger is constituted by an outer plunger and an inner plunger slidably arranged in an axial portion of said outer plunger, said inner plunger has a diameter smaller than a maximum diameter of said gate and is caused to project from an upper surface of said outer plunger, after casting, to be inserted into said gate, and a coolant passage is formed in each of said inner plunger, said outer plunger, and said pressure pin.

8. A vertical die casting apparatus according to claim 7, wherein said inner plunger has a diameter larger than a minimum diameter of said gate and smaller than the maximum diameter of said gate.

9. A vertical die casting apparatus having a lower stationary mold, an upper movable mold, a casting unit in which a vertical casting sleeve having a casting plunger therein is detachably mounted on a casting port under said stationary mold, a frustoconical vertical gate arranged above said casting port in said stationary mold to be coaxial with said casting port and having a diameter smaller than that of said casting port, said gate having a maximum-diameter portion on its lower side and a minimum-diameter portion on its upper side, and a pressure pin having a diameter slightly smaller than a minimum diameter of said gate and capable of moving downward from a lower surface of said movable mold into at least said minimum-diameter portion of said gate, wherein said casting plunger is constituted by an outer plunger and an inner plunger fixed to an axial portion of said outer plunger, said inner plunger has a projecting portion having a diameter smaller than a maximum diameter of said gate and projecting from an upper surface of said outer plunger to be able to be inserted in said gate during casting, and a coolant passage is formed in each of said inner plunger, said outer plunger, and said pressure pin.

10. A vertical die casting apparatus according to claim 9, wherein said casting plunger is formed by integrally assembling an inner plunger portion and an outer plunger portion that are separate from each other.

11. A vertical die casting apparatus according to any one of claims 7 to 10, wherein an inner surface of said gate forms a tapered surface a diameter of which decreases toward an upper portion of said gate, and a diameter of a portion of said inner plunger which is inserted in said gate is set smaller than a maximum diameter of an inlet port of said gate by 10 mm to 30 mm.

12. A vertical die casting apparatus according to claim 7 or 9, having an operation instruction unit for moving said pressure pin downward to a portion near said minimum-diameter portion in said gate immediately or after a lapse of several seconds since said inner plunger is inserted in said gate.

13. A vertical die casting apparatus according to claim 7 or 9, having an operation instruction unit for moving said pressure pin downward to a portion near said minimum-diameter portion in said gate immediately or after a lapse of several seconds since said inner plunger is inserted in said gate, moving said casting sleeve and said casting plunger downward when a time required for solidification of a mold product in said cavity or a biscuit has elapsed, and moving said pressure pin further downward.

* * * * *